United States Patent [19]

Aslund

[11] 4,369,078

[45] Jan. 18, 1983

[54] PROCESS AND AN APPARATUS FOR CONVERTING LUMP-SIZE MATERIAL OF TITANIUM METAL OR ITS ALLOYS INTO POWDER-FORM MATERIAL AND PRESSINGS

[75] Inventor: Christer Åslund, Torshälla, Sweden

[73] Assignee: NYBY Uddeholm AB, Torshälla, Sweden

[21] Appl. No.: 154,020

[22] Filed: May 28, 1980

[30] Foreign Application Priority Data

May 28, 1979 [DE] Fed. Rep. of Germany ..... 2921593

[51] Int. Cl.[3] ..... B22F 1/00

[52] U.S. Cl. ..... 148/126; 419/33; 419/68; 241/5; 241/18

[58] Field of Search ..... 75/213, 226; 148/126

[56] References Cited

U.S. PATENT DOCUMENTS

| | | | |
|---|---|---|---|
| 3,469,976 | 9/1969 | Iler | 75/226 |
| 3,622,313 | 11/1971 | Havel | 75/226 |
| 3,649,242 | 3/1972 | Arias | 75/213 |
| 3,744,993 | 7/1973 | Matt et al. | 75/213 |

FOREIGN PATENT DOCUMENTS

| | | | |
|---|---|---|---|
| 52-74559 | 6/1977 | Japan | 75/213 |

OTHER PUBLICATIONS

Perry et al, Chemical Engineer's Handbook, 1975, pp. 43 and 44.

*Primary Examiner*—Brooks H. Hunt

*Attorney, Agent, or Firm*—Antonelli, Terry & Wands

[57] ABSTRACT

This invention relates to a process and an apparatus for converting lump-size material, particularly scrap, of titanium metal or its alloys, preferably of low oxygen content, into powder-form material, which is useable for forming in a powder-metallurgical way pressings and workpieces, wherein the lump-size material is highly embrittled by charging with hydrogen, the embrittled material is size-reduced by means of size-reducing machines, particularly impeller breakers, impact mills, hammer mills, impact hammer mills or hammer breakers, the size-reduced brittle material preferably having a particle size of less than about 10 mm and more particularly of less than about 6 mm is further size-reduced by means of at least one jet stream by impinging on a baffle plate or an anvil or on the particles of at least one other jet stream for the purpose of conversion into the powder-form material, and the powder-form material is converted into the ductile state by heating, preferably at temperatures above 450° C. and more particularly at temperatures above 700° C., preferably under reduced pressure and more particularly under a reduced pressure of the order of $10^{-1}$ Torr or lower.

17 Claims, 1 Drawing Figure

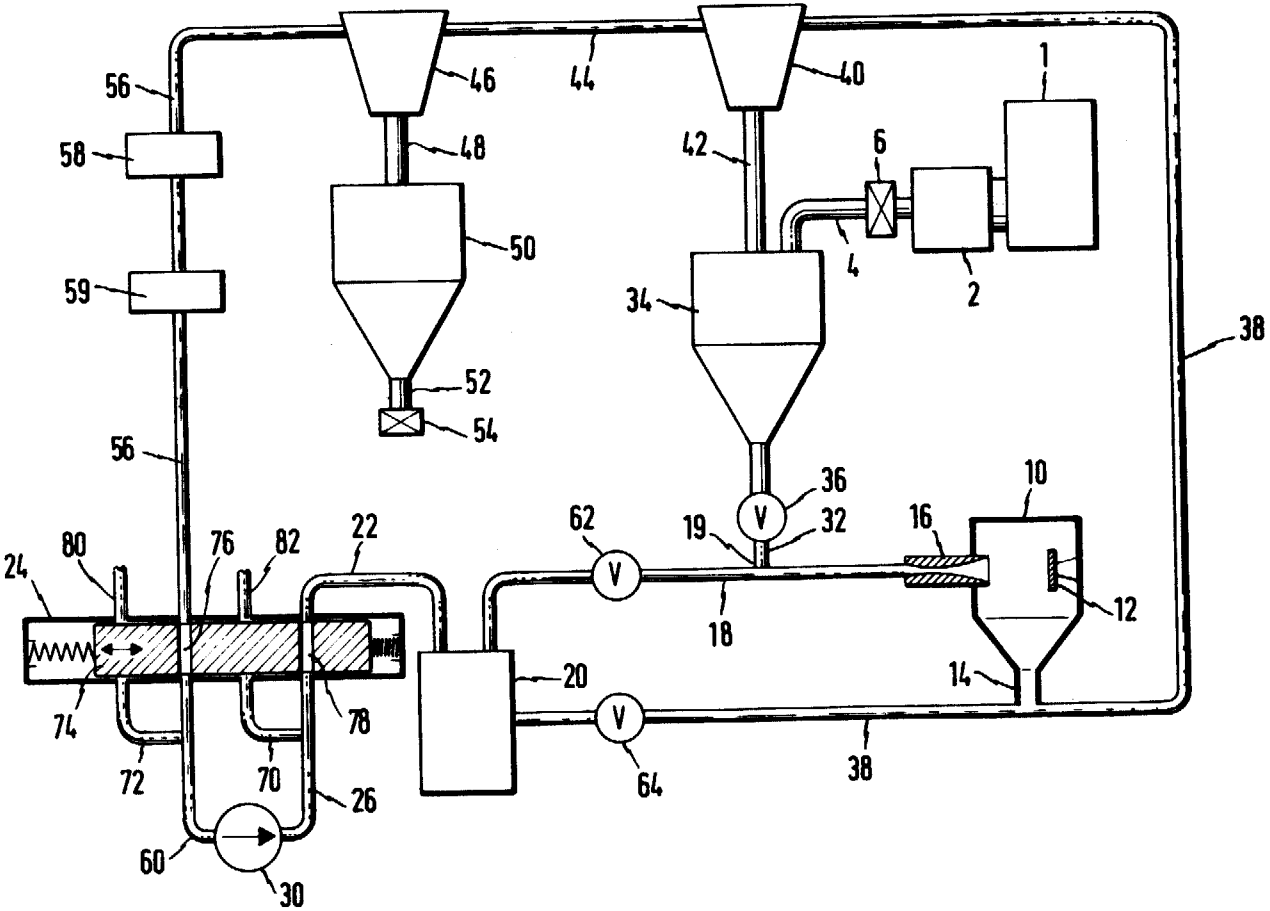
38
1
2
6
4
40
42
34
44
46
48
50
52
54
56
58
59
56
10
12
16
14
38
36
32
19
18
62
64
20
22
78
26
82
70
30
76
60
72
80
74
24

PROCESS AND AN APPARATUS FOR CONVERTING LUMP-SIZE MATERIAL OF TITANIUM METAL OR ITS ALLOYS INTO POWDER-FORM MATERIAL AND PRESSINGS

This invention relates to a process and an apparatus for converting lump-size material, particularly scrap, of titanium metal or its alloys, preferably of low oxygen content, into powder-form material.

The object of the present invention is to provide a process and an apparatus which enable lump-size material, particularly scrap, of titanium metal or its alloys to be economically converted into powder-form material which may be pressed, particularly by the cold isostatic method, into pressings from which workpieces, particularly workpieces of the type used in the chemical industry, in pump, fan and aircraft construction, may be produced.

According to the invention, this object is achieved in that the lump-size starting material is highly embrittled by charging with hydrogen, the embrittled material is size-reduced by means of size-reducing machines, particularly impeller breakers, impact mills, hammer mills, impact hammer mills or hammer breakers, the size-reduced brittle material preferably having a particle size of less than about 10 mm and, more particularly, less than about 6 mm is further size-reduced by means of at least one jet stream by impinging on a baffle plate or an anvil or on the particles of at least one other jet stream for the purpose of conversion into powder-form material and the powder-form material obtained is converted into the ductile state by heating, preferably above 450° C. and, more particularly, above 700° C., preferably under reduced pressure and, more particularly, under a reduced pressure of about $10^{-1}$ Torr or lower.

The powder produced in accordance with the invention affords the advantage that it has a low oxygen content which does not exceed or is below the normally permitted limit of 800 ppm and which is also obtained for example in REP powder, i.e. powder produced by the rotary electrode process.

According to the invention, it can be of advantage for at least part of the embrittled material further size-reduced by jet stream to be re-introduced into the at least one jet stream for the purpose of obtaining a finer and/or more uniform size reduction. The extent and/or frequency of the repeated introduction of the embrittled material into the at least one jet stream may be controlled in accordance with the degree of the required size-reduction.

The degree of size reduction may be controlled in particular by recycling at least part of the brittle material size-reduced by means of the at least one jet stream for a controllable period to the at least one jet stream. In this connection, it can be of advantage to recycle only particles which exceed a predetermined size.

According to the invention, the particles of the embrittle material may be projected against one another by means of at least two jet streams which include an obtuse angle with one another, preferably an angle of from about 135° to about 175°.

It is also possible to direct at least four jet streams against one another at obtuse angles from opposite sides and from above and below. In particular, two jet streams may be directed against one another in a first plane at an obtuse angle preferably amounting to between about 135° and about 175°, whilst another two jet streams may be directed against one another, preferably in a second plane substantially perpendicular to the first plane, at an obtuse angle preferably amounting to between about 135° and about 175°, the arrangement being such that these four jet streams are introduced into one half of a substantially spherical baffle chamber through the wall thereof, whilst the wall of the other half of the baffle chamber is in the form of a baffle plate or is provided with baffle plates, particularly substantially in the form of a hollow sphere sector. It can also be of advantage to direct six jet streams to the centre of a baffle chamber from six different sides, in which case the six jet streams are directed to the centre of the baffle chamber parallel to the directions of the coordinate axes of a rectangular xyz-coordinate system of which the zero point is situated at the centre of the baffle chamber. In this connection, it is of advantage to turn the xyz-coordinate system in such a way that three of the jet streams are directed towards the middle of the baffle chamber inclined from below whilst the other three are directed towards the middle of the baffle chamber obliquely from above. The advantage of this is that there is no need for any jet stream to be introduced through the base of the baffle chamber, so that the base of the baffle chamber may be in the form of a funnel-like outlet for the powder particles.

The charging of the starting material with hydrogen is preferably carried out at elevated temperature, preferably at temperatures above 200° C. and, more particularly, at temperatures above 300° C. in a pure hydrogen atmosphere which is also maintained for cooling.

The charging of the starting material with hydrogen may be carried out with advantage in a bright annealing furnace for products of stainless steel, in which case the starting material is heated for about 15 minutes at temperatures of the order of 800° C. and, more particularly, 830° C. in an atmosphere essentially consisting of pure hydrogen, and is then cooled in this hydrogen atmosphere.

Pulverisation of the material in the jet stream is preferably carried out in an inert gas atmosphere, preferably an argon atmosphere, or in a hydrogen atmosphere or a nitrogen atmosphere. The powder-form material is also generally handled in an inert gas atmosphere, preferably an argon atmosphere, and/or a nitrogen atmosphere and/or a hydrogen atmosphere.

According to the invention, the working gas, particularly argon, which is used for size-reduction in the jet stream may be recovered from the circuit.

According to the invention, the powder-form material obtained, before being converted into the ductile state, may be pressed, preferably by the cold isostatic method, to form pressings which may then be converted into the ductile state by heating, preferably at temperatures above 450° C. and, more particularly, at temperatures above 700° C., preferably under reduced pressure and, more particularly, under a reduced pressure of the order of $10^{-1}$ Torr.

Alternatively, it is possible in accordance with the invention to press the powder-form material to form pressings after and/or during its conversion into the ductile state by heating, preferably at temperatures above 450° C. and, more particularly, at temperatures above 700° C. and preferably in a reduced pressure atmosphere, more particularly in a reduced pressure atmosphere of the order of $10^{-1}$ Torr or lower.

According to the invention, the powder obtained may be subjected to cold isostatic pressing in elastic moulds, the powder being compacted within the moulds, preferably by vibration and/or ultrasound.

The moulds may advantageously consist of plastics and voids intended to exist within the pressings may be formed by hollow plastics mouldings which are filled from outside via passages with the liquid used for the isostatic pressing operation.

Through the impingement of the parts or rather powder particles to be size-reduced on the baffle plate, these powder particles are given a texture and regular surface which favourably affects their pressing properties. The textured particle form which the powder size-reduced by the process according to the invention shows provides for a high packing density so that the powder obtained is particularly suitable for cold isostatic pressing or other forming operations.

According to the invention, jet stream pulverisation may be combined with an apparatus for atomising the powder in an inert gas so that the same pressure source or rather the same compressor may be used.

The working gas, for example an inert gas, particularly argon, is preferably recovered from the circuit.

The powder is preferably compacted in the moulds before pressing by vibration and/or ultrasound.

According to the invention, the mould may consist of plastic and voids intended to exist within the pressings may be formed by hollow plastics mouldings which are filled form outside through passages with the liquid used for isostatic pressing.

The cold isostatic pressure used in preferably in the range from about 2000 to 5000 bars and, more particularly, in the range from 3000 to 4000 bars.

According to the invention, the inside of the plastic mould may be lined before introduction of the powder with foils, preferably of low alloyed carbon steel and preferably having a thickness of less than 0.05 mm and, more particularly, of the order of 0.02 mm, these foils remaining on the pressing and at least partly closing its pores after the plastic mould has been mechanically detached, as is preferably the case, and/or burnt.

According to the invention, the pressings may be introduced into a pressure vessel, preferably after their pores have been sealed by overcoating with a layer of glass, particularly by immersion in a glass melt of high viscosity, and may then be subjected to hot isostatic pressing at elevated temperature and pressure.

It has proved to be of particular advantage to immerse the pressings, particularly the foil-covered pressings, in an initially highly viscous glass melt having a relatively low temperature, for example 900° C., and to use this glass melt as the pressure medium for the hot isostatic pressing operation, the pressure and temperature of the glass melt being controlled in such a way that, on account of its viscosity, the glass melt does not penetrate into the pores of the pressing to any significant extent, the temperature of the glass melt only being gradually increased, for example to 1200° C., after the pressing has been compressed to such an extent that it has hardly any more pores suitable for penetration of the glass melt.

During the above mentioned pressing operation, a pressure of preferably around 1000 bars and, more particularly, of the order of 1500 bars is applied to the glass melt.

The apparatus according to the invention for carrying out the process is characterised by a furnace for charging the starting material with hydrogen, a size-reducing machine which produces particles less than about 5 mm in diameter and a baffle chamber into which the material to be pulverised is blown or projected by means of a jet stream or several jet streams directed against a baffle wall and/or against the material to be pulverised of another jet stream. Each jet stream preferably comprises a Venturi nozzle from which the material to be pulverised is projected by means of a high pressure stream of a working gas, particularly an inert gas, preferably argon or hydrogen or nitrogen.

The apparatus according to the invention preferably comprises first and second cyclone separators, the coarse particles retained in the first cyclone separator preferably being returned to the jet stream.

According to the invention, it is possible to provide a reversing valve by means of which the compressor may be switched over from the jet stream pulverising apparatus to an apparatus for atomising powder in an inert gas, particularly argon.

An example of embodiment of the invention is described in detail in the following with reference to the accompanying diagrammatic drawing. The drawing shows a furnace 1 for charging the starting material with hydrogen. The embrittled starting material is then size-reduced to a particle size of less about 6 mm by means of a size-reducing machine 2 and is delivered, preferably in batches, to a storage vessel 34 through a pipe 4 which is provided with a distributor 6 in the form of a lock.

Arranged in a baffle chamber 10 is a baffle plate 12 on which the metal particles to be pulverised impinge and are guided through the funnel-shaped base of the baffle chamber 10 to the outlet 14. The particles to be pulverised are projected into the baffle chamber 10 at high speed by means of a Venturi nozzle 16. A gas stream for accelerating the particles to be pulverised is delivered through a pipe 18 connected to a high-pressure source 20. The high-pressure source 20 is connected to a compressor 30 via a pipe 22, a valve 24 and a pipe 26.

The pipe 18 is connected at 19 to the outlet 32 of the storage and collecting vessel 34 in which the particles to be pulverised are accommodated. The quantity of particles flowing into the pipe 18 is measured by means of a valve or a metering unit 36. The pulverised particles are delivered through the outlet 14 into a pipe 38 which is also connected to the high-pressure source 20 so that the pulverised particles are guided by means of a pressure gas stream in the pipe 38 to a first cyclone separator 40 which returns all the particles exceeding a predetermined size via a pipe 42 to the storage and collecting vessel 34 and only delivers fine powder, for example less than 200$\mu$ in diameter, via a pipe 44 to a second cyclone separator 46 in which the working gas is separated from the fine powder for delivery to the compressor whilst the powder is delivered via a pipe 48 to a collecting vessel 50 of which the outlet 52 is provided with a lock-like valve assembly 54 by means of which the powder may be introduced under the protection of working gas into a transportable container (not shown) designed for connection to the valve assembly 54. The working gas is returned from the cyclone separator 46 to the compressor 30 via a pipe 56, in which there are two dust filters 58 and 59, a valve assembly 24 and a pipe 60. Control valves 62 and 64 are built into the pipes 18 and 38, enabling the gas streams in these pipes to be coordinated with one another.

The apparatus according to the invention may be combined with an apparatus for producing powder atomised in an inert gas, preferably argon. By means of the valve assembly 24, it is possible to use the compressor 30 both for the apparatus for pulverising particles in a jet stream and for the apparatus for atomising powder in an inert gas (argon). To this end, the pipes 26 and 60 comprise branch pipes 70 and 72 which, when the valve 74 is moved into its left-hand position, are connected to the openings or bores 76 and 78 in the valve 74, which are then in alignment with the branch pipes 70 and 72, the pipes 80 and 82 which lead to the apparatus for atomising the powder in an inert gas (argon) which is not shown and which comprises a trunk-like container under argon or inert gas pressure. Accordingly, the reversing valve 24 enables the compressor 30 to be used both for inert gas atomisation and also for jet stream pulverisation. Since the working gas is recycled, the losses are minimal.

EXAMPLE 1

Titanium scrap from a machining operation was converted by treatment with hydrogen at 450° C. into a brittle form which could easily be size-reduced to a particle size of less than 5 mm in an impellor breaker. The particles thus obtained were further size-reduced by pulverisation in a jet stream to a powder having a maximum particle size of 150μ. After this process step, the powder was dehydrated by vacuum annealing, for example at 700° to 750° C./0.1 Torr. This last process step may also be carried out when the powder has been compacted into a pressing, in which case sintering is automatically obtained. The process according to the invention gives a Ti powder which has a very low oxygen content of less than 800 ppm.

EXAMPLE 2

Using the same process steps as in Example 1, the same results were obtained with scrap of the titanium alloy Ti-6Al-4V as starting material.

All the particulars and features disclosed in the documents, particularly the spatial configuration disclosed, are claimed as essential to the invention where they are new in relation to the prior art either individually or in combination.

I claim:

1. A process for converting lump-size material formed of titanium metal or its alloys into powder-form material which comprises the following steps wherein:

(a) the lump-size material is highly embrittled by being charged with hydrogen;

(b) the embrittled lump-size material is reduced in size within a device having means for impacting on the lump-size material;

(c) the initially size-reduced material having a particle size of below 10 mm is introduced into a jet stream of non-oxidizing gas;

(d) the jet stream containing the size-reduced material is caused to impinge on a baffle wall within a chamber; and (e) the resulting fine powder is dehydrogenated at temperatures above 450° C. and under a vacuum of at least $10^{-1}$ Torr to convert the fine powder into a ductile state.

2. A process according to claim 1, wherein at least part of the embrittled material further size-reduced in step (c) is re-introduced into the jet stream for the purpose of obtaining finer and more uniform size reduction.

3. A process according to claim 2, wherein the frequency of the repeated introduction of the embrittled material into the jet stream is controlled in accordance with the required degree of size-reduction.

4. A process according to claim 1, wherein at least part of the embrittled material size-reduced by the jet stream is recycled for a controllable period to the jet stream.

5. A process according to claim 1, wherein the charging of the material with hydrogen is carried out at elevated temperature above 200° C., in a pure hydrogen atmosphere which is also maintained for cooling.

6. A process according to claim 5, wherein the material is charged with hydrogen in a bright annealing furnace for stainless steel, the material being heated for about 15 minutes at temperatures of the order of 800° C. in an atmosphere consisting essentially of pure hydrogen, and being cooled in this hydrogen atmosphere.

7. A process according to claim 1, wherein pulverization of the material by means of the jet stream is carried out in the non-oxidizing gas which comprises an inert gas atmosphere containing argon, hydrogen or nitrogen or a mixture thereof.

8. A process according to claim 1, wherein, before being converted into the ductile state, the powder-form material obtained is pressed by the cold isostatic method to form pressings which are then converted into the ductile state by heating at temperatures above 450° C. under reduced pressure.

9. A process according to claim 1, wherein the powder-form material is pressed to form pressings after conversion into the ductile state.

10. A process according to claim 1, wherein the ductile powder obtained is subjected to cold isostatic pressing in elastic moulds.

11. A process according to claim 10, wherein the powder is compacted in the moulds by vibration.

12. A process according to claim 10 or 11, wherein the mould consists of plastic and voids intended to remain in the pressing are formed by hollow plastics mouldings which are filled from outside through passages with the liquid used for the isostatic pressing operation.

13. A process according to claim 12, wherein, before the powder is introduced, the inside of the plastics mould is lined with foils of low-alloyed carbon steel having a thickness of less than 0.05 mm and these foils remain on the pressing and close its pores after the plastics mould has been removed.

14. A process according to claim 13, wherein the pressings are introduced into a pressure vessel after their pores have been sealed by overcoating with a layer of glass and are then subjected to hot isostatic pressing at elevated temperture and pressure.

15. A process according to claim 14, wherein the foil-covered pressings are immersed in an initially high-viscosity glass melt which is used as pressure medium for the hot isostatic pressing operation, the pressure and temperature of the glass melt being controlled in such a way that, on account of its viscosity, the glass melt does not penetrate into the pores of the pressing to any significant extent and the temperature of the glass melt is only increased when the pressing has been compressed to such an extent that it has hardly any more pores suitable for penetration of the glass melt.

16. An apparatus for converting lump-size material of titanium or its alloys into powder-form material which comprises a furnace for charging the lump-size material with hydrogen, a size-reducing device having means for impacting on the lump-size material whereby the lump-size material is initially pulverized, a baffle chamber with a Venturi nozzle and a baffle plate, means for introducing the initially size-reduced particles obtained from the size-reducing device in a jet stream into the chamber via said nozzle to cause the particles to impinge on said plate, means for removing the resulting fine powder from the baffle chamber and means for transporting the fine powder from said chamber.

17. An apparatus according to claim 16, wherein first and second cyclone separators are provided and said means for transporting the fine particles lead to the first cyclone separator wherein the more coarse particles are retained and are returned to the jet stream for further processing.

* * * * *